United States Patent [19]

McVaugh

[11] 4,103,757

[45] Aug. 1, 1978

[54] TRIPOD AERIAL LIFT

[76] Inventor: Arthur K. McVaugh, 2009 Old Sumneytown Pike, Harleysville, Pa. 19438

[21] Appl. No.: 811,730

[22] Filed: Jun. 30, 1977

[51] Int. Cl.[2] ..... B66F 11/04

[52] U.S. Cl. ..... 182/2; 182/19

[58] Field of Search ..... 182/2, 141, 148, 82, 182/19

[56] References Cited

U.S. PATENT DOCUMENTS

| | | | |
|---|---|---|---|
| 2,996,195 | 8/1961 | Hansen | 182/2 |
| 3,166,153 | 1/1965 | Reed | 182/2 |
| 3,534,832 | 10/1970 | Rediske | 182/2 |
| 3,610,367 | 10/1971 | Atchey | 182/2 |
| 3,807,575 | 4/1974 | Merrick | 182/2 |

*Primary Examiner*—Reinaldo F. Machado
*Attorney, Agent, or Firm*—Paul & Paul

[57] ABSTRACT

A man-carrying aerial bucket universally positionable in three planes is mounted on a tripod arrangement comprising three hydraulic cylinders. The upper ends of the cylinder pistons converge toward, and are connected to, a universal vertex connector pin assembly. A lateral arm has one end pivotally connected to the vertex pin assembly and its other end pivotally connected to the lower end of a vertical boom. The basket is pivotally connected to the upper end of the boom and is latched in upright position against swinging on the boom. Solenoid valves, under the manual control of the operator from either the aerial bucket or truck vehicle, control the extension and retraction of the cylinder pistons and hence the position of the vertex pin assembly and the bucket supported thereon. A pair of hydraulic leveling cylinders, controlled automatically by mercury switches, maintain the lateral arm in horizontal position and the latched boom in vertical position irrespective of the angular disposition of the tripod.

16 Claims, 8 Drawing Figures

TRIPOD AERIAL LIFT

BACKGROUND OF THE INVENTION

This invention relates to man-carrying aerial bucket of the type that is mounted on a motor truck or other mobile vehicle and used for a variety of purposes, such as by the electrical utility companies for maintenance work on pole lines, overhead wires, transformers and light fixtures, the trimming of trees and branches for wire clearance, and by state, country, township, municipal and other government branches for maintenance work on overhead highway lights, traffic lights, elevated highway signs, and the like.

Prior art apparatus provided for the above and similar purposes have usually comprised a hydraulically operated telescoping boom mounted on a turret supported on the motor truck or other mobile vehicle, with the turret being continuously rotatable through 360°, as by means of a collector block or collector rings.

Collector blocks may be avoided in hydraulic systems, and collector rings may be avoided in electrical systems, at the sacrifice of continuous rotation in one direction. Less expensive devices have been provided by the prior art which are not continuously rotatable through 360° in one direction. The disadvantage of such mechanism is that if the bucket is at say 11 o'clock (on an imaginary clock face) and you want to go to 1 o'clock, the bucket must return counterclockwise through 6 o'clock since the boom is not movable from 11 through 12 to 1 o'clock in a clockwise direction.

SUMMARY OF THE INVENTION

One of the objects of the present invention is to provide an aerial lift which is rotatable continuously through 360° but without using a continuously rotatable boom turret and without using collector blocks or collector rings, thereby making the space ordinarily taken by this equipment in the center of the truck body available for other purposes.

Another object is to provide a relatively inexpensive tripod construction for supporting an aerial load, and a control system for moving the load universally to desired positions in three planes.

Another object is to provide a relatively inexpensive apparatus for mounting a man-carrying aerial bucket on a motor truck, or for that matter on a stationary platform, and for moving the bucket to an infinite number of positions in three planes within the range of the strokes of a tripod of hydraulic cylinders, with controls for the hydraulic cylinders being provided both on the truck and also within the aerial bucket.

The foregoing as well as other objects are achieved, according to a preferred form of the present invention, by providing a tripod configuration comprising three hydraulic cylinders. The lower ends of the cylinders are adapted to be mounted in a triangular configuration on the truck on three two-plane universal pin connection mountings. The upper ends of the cylinder pistons coverge toward and are pivotally connected by fittings to a vertex universal pin connection. Also pivotally connected to the vertex universal pin connection or joint is a lateral arm, and pivotally connected to the other end of the lateral arm is the lower end of a vertical jib boom to the upper end of which the bucket is pivotally connected and latched against swinging. Leveling means, comprising a pair of leveling cylinders and the necessary associated mercury switches, are provided for maintaining the lateral arm always horizontal and for maintaining the jib boom always vertical irrespective of the angular position of the tripod. Manual controls for the hydraulic system are provided both on the truck and also in the aerial bucket. The tripod means just described is capable of positioning the aerial bucket, within the limits of the strokes of the hydraulic cylinders, at any desired point in the X, Y or Z planes with the man-carrying aerial bucket being always maintained automatically in the vertical upright position (except during mounting and de-mounting as will be described).

DETAILED DESCRIPTION OF THE PREFERRED EMBODIMENTS

Figure 1:
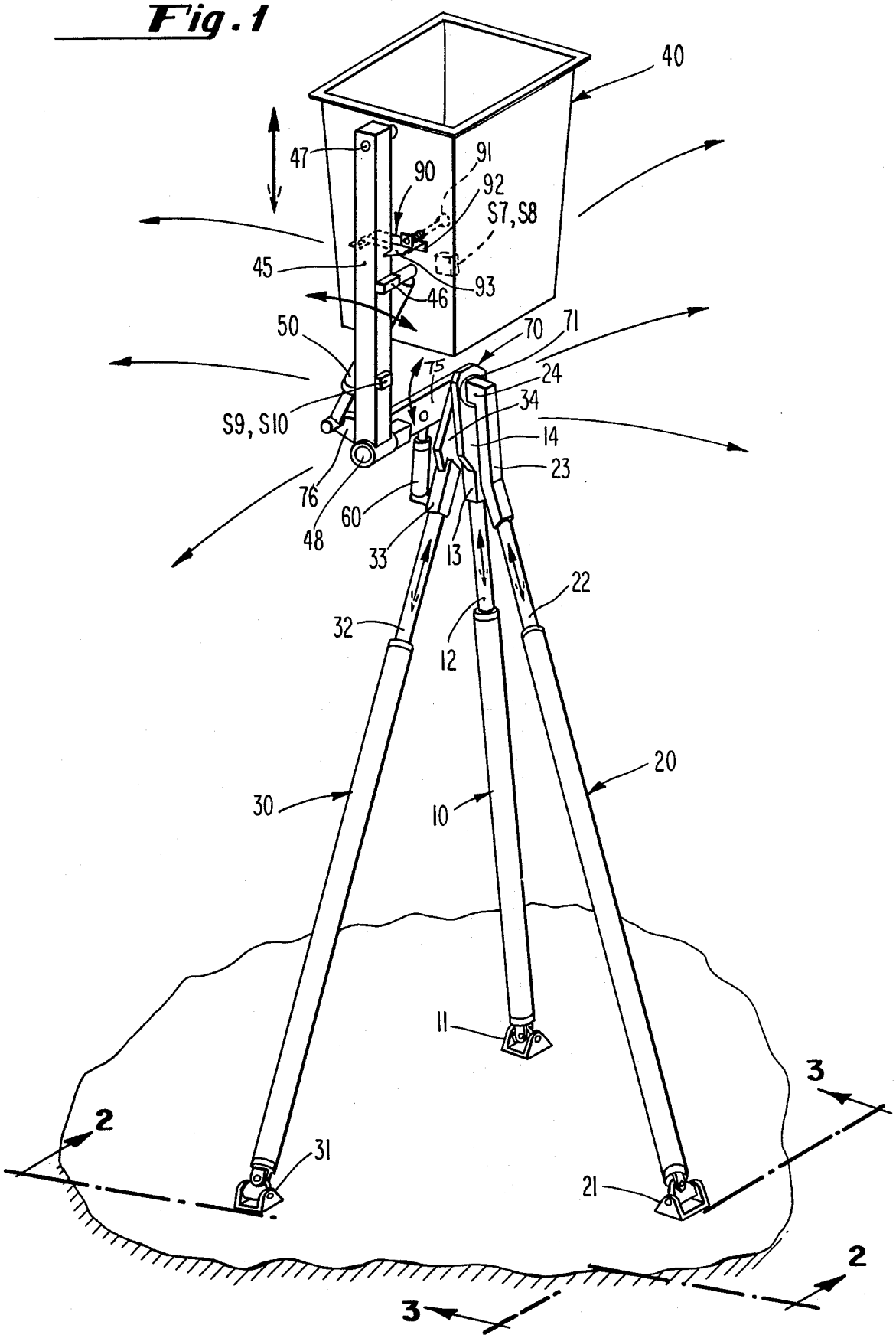
FIG. 1 is a perspective view of a 3-plane infinitely variable positioning aerial platform or man-carrying bucket according to the present invention.

FIG. 1 illustrates one form of aerial platform or lift according to the present invention. In comparison with prior art apparatus, the apparatus illustrated is relatively simple and inexpensive, yet is capable of placing the aerial bucket in an infinitely variable number of positions in three planes, within the stroke range of the hydraulic cylinders and within the angular limitations which have been imposed, as will be discussed later.

The apparatus shown is a tripod type whose three legs comprise hydraulic cylinders 10, 20 and 30 which terminate in a vertex universal joint on which the aerial platform or man-carrying bucket 40 is supported. Automatic means are provided for maintaining the bucket 40 in an upright position irrespective of its aerial position as determined by the legs of the tripod. Such automatic means include a jib boom 45 which is latched to the bucket 40 and which is automatically maintained in a vertically upright position by a pair of hydraulic leveling cylinders 50 and 60 controlled automatically by two pairs of mercury switches. Upper leveling cylinder 50 is controlled by mercury switches S-7 and S-8. Lower leveling cylinder 60 is controlled by mercury switches S-9 and S-10. These mercury switches are shown in the schematic electrical system shown in FIG. 5.

The lower or barrel ends of the three hydraulic cylinders 10, 20, 30 are each connected to a two-plane universal pin connection mounting, 11, 21 and 31, respectively. These mountings may be used to secure the tripod apparatus on a mobile truck and the truck, so equipped, may then be used for a variety of purposes, including salvaging over-head electrical cable. In such case, the truck may be similarly equipped so that shown in my U.S. Pat. No. 3,799,016, issued Mar. 26, 1974.

Figure 7:
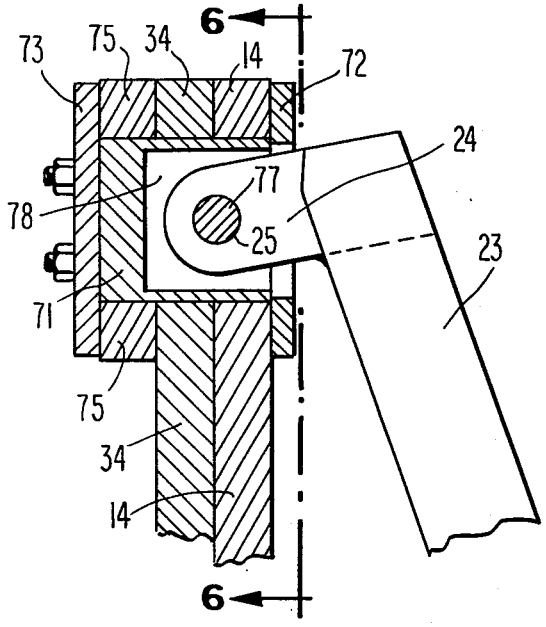
FIG. 7 is a view, in section, of the universal vertex connector pin assembly looking along the line 7—7 of FIG. 6.
Figure 6:
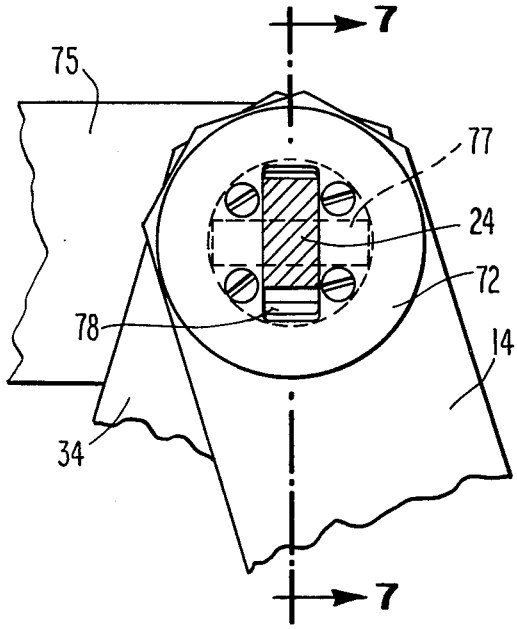
FIG. 6 is a view of the universal vertex connector pin assembly looking along the line 6—6 of FIG. 7.
Figure 8:
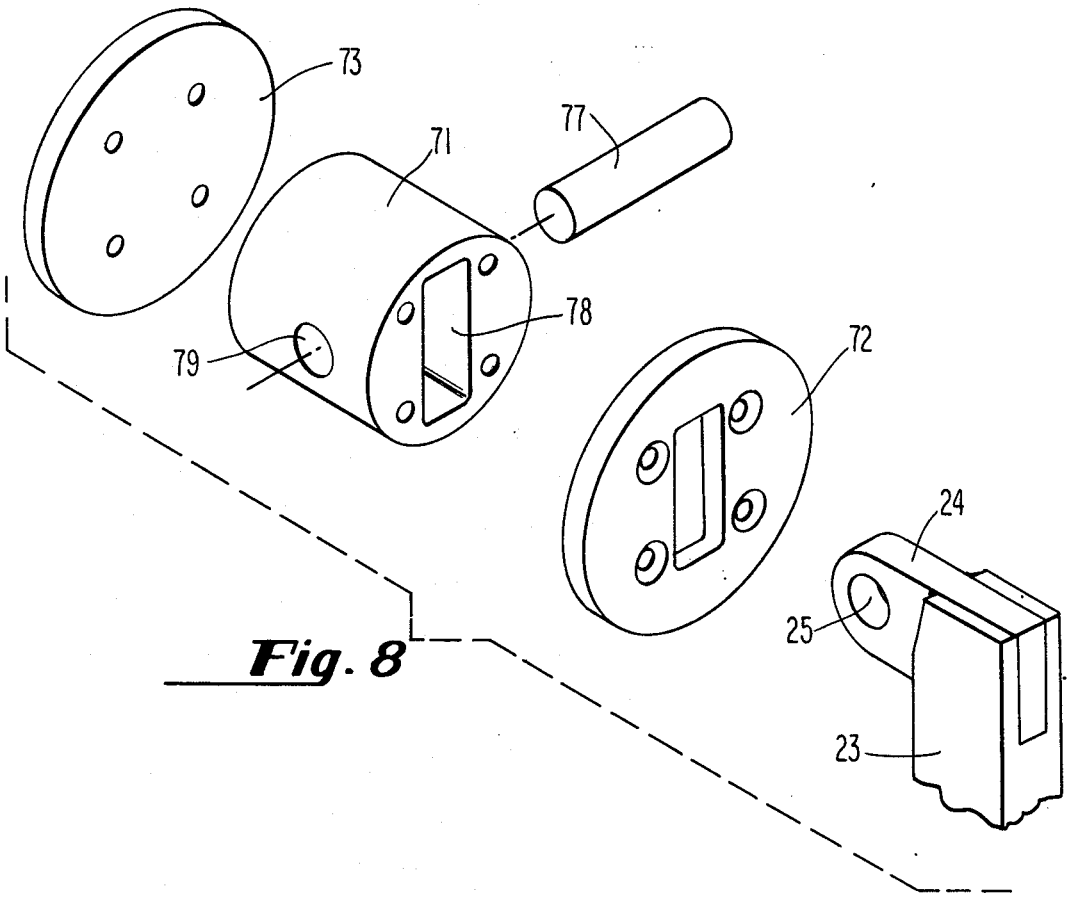
FIG. 8 is an exploded view showing in perspective the various component parts of the universal vertex connector pin assembly.

The hydraulic cylinders 10, 20 and 30 have elongated extendable-retractable piston rods 12, 22 and 32, respectively, which terminate at their upper ends in fittings 13, 23 and 33, respectively. Cylinders 10 and 30 are in alignment and their piston fittings 12 and 32 have right and left offset portions 14 and 34, respectively. As best seen in FIGS. 6–8, each offset 14, 34 is provided with a circular hole at its upper end (FIG. 7) for receiving the cylindrical barrel 71 (FIGS. 7 and 8) of a vertex universal joint or connector 70. Fitting 23 of the center piston rod 22 is provided at its upper end with a lateral disposed tang 24 of rectangular cross section which is received within a rectangular hole 78 in barrel 71. The width of rectangular hole 78 in barrel 71 corresponds to the width of tang 24 but the height of the rectangular hole 78 is substantially greater than that of the tang 24 to allow the tang to move pivotally on a transverse pin 77 in barrel 71. The forward portion of tang 24 is provided with a circular transverse hole 25 through which passes the cylindrical pin 77. Pin 77 is received within a cylindrical hole 79 which passes transversely through the barrel 71. In this fashion, piston 22 is secured to the barrel 71 of the vertex joint 70.

Since barrel 71 is rotatable within the holes in portions 14, 34, of fittings 13 and 33, the pistons 12 and 32 may be individually extended or retracted as desired to move the vertex joint 70 in the common plane occupied by cylinders 10 and 30.

Movement of vertex joint 70 in a plane at right angles to the common plane of cylinders 10 and 30 is controlled by cylinder 20. In such movement, tang 24 pivots on the transverse pin 77 within barrel 71.

Elevation vertically of vertex joint 70 is controlled by all three of the cylinders. It will be seen that as the vertex joint is pushed upwardly along a straight vertical line by extension of the piston rods 12, 22, 32 the angle between cylinders 10 and 30 will decrease and offset portions 14 and 34 will move angularly toward each other on the barrel 71. At the same time, tang 24 of fitting 23 will move pivotally on the transverse pin 77 in barrel 71.

Also supported for pivotal movement on barrel 71 of the vertex joint 70 is a lateral arm 75, and supported for pivotal movement at pivot pin 48 at outer end of arm 75 is a vertical jib boom 45. A lower hydraulic leveling cylinder 60 functions, under the control of a pair of mercury switches S9 and S10 (FIG. 5), to maintain arm 75 always in level or horizontal positions irrespective of the position of the tripod. An upper hydraulic leveling cylinder 50 functions, under the control of another pair of mercury switches S7 and S8, to maintain jib boom 45 always in vertical position irrespective of the position of the tripod.

In FIG. 1, one end of horizontal leveling cylinder 60 is pivotally connected to lateral arm 75 while the other end is pivotally connected to fitting 33 of piston 32 of cylinder 30. The pair of mercury switches S9 , S10 which control cylinder 60 are arbitrality shown mounted on jib boom 45. They could be mounted elsewhere.

In FIG. 1, one end of vertical leveling cylinder 50 is shown connected pivotally at 46 to jib boom 45 while the other end is shown connected pivotally to a bracket 76 connected at right angle to lateral arm 75. The pair of mercury switches which control vertical leveling cylinder 50 are arbitrarily shown to be mounted within the bucket 40.

Bucket 40 is supported pivotally on pin 47 secured to the upper end of boom 45.

A spring biased latch mechanism identified generally by the reference numeral 90 holds the bucket 40 in vertical upright position relative to the jib boom 45. Thus, if the jib boom 45 is automatically maintained in vertical position by the mercury switches S7, S8, the bucket 40 will be maintained in vertical upright position.

Figure 4:
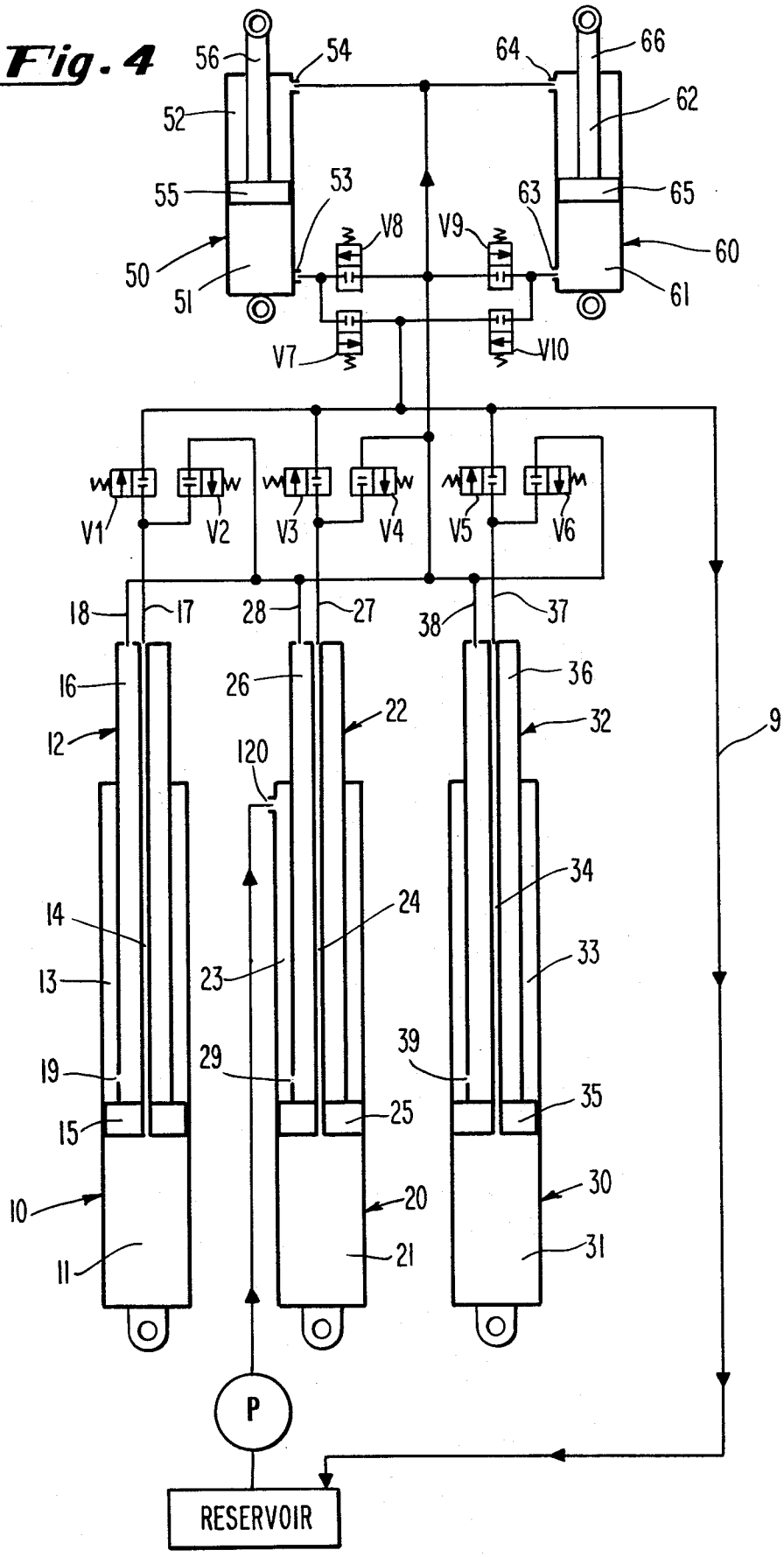
FIG. 4 is a schematic illustration of a hydraulic system which may be used to control the extension and retraction of the hydraulic cylinders of the apparatus, thereby to control the position into which the bucket is placed.

Referring now to FIG. 4, this figure is a schematic illustration of the hydraulic system by which manual control of the tripod cylinders 10, 20 and 30, and by which automatic control of the leveling cylinders 50 and 60, are achieved. Each tripod cylinder 10, 20 and 30 comprises a cylindrical body or barrel, 11, 21 and 31 respectively, and within the barrels are pistons 12, 22 and 32, respectively. Each piston has a head 15, 25 and 35, and each piston has an elongated hollow cylindrical rod portion 16, 26 and 36, respectively. Extending for the full length of each piston rod and through each piston head, on the center axis thereof, is an oil pipe 14, 24 and 34. These pipes are open at each end. The openings at the lower or piston-head end provide communication to the lower portion of the barrels 11, 21 and 31 which are below the piston heads 15, 25 and 35. The upper ends of the oil pipes 14, 24 and 34 are connected to hoses 17, 27 and 37 which connect through solenoid valves V1,V3,V5 to the return line 9 to the oil reservoir.

In FIG. 4, the valves V1 through V6 are shown to be biased, as by extension springs, to their normally closed positions. These valves V1 through V6 may be actuated individually to their open positions by electrical circuitry illustrated in FIG. 5 and described later.

In the normally closed positions of valves V1 through V6, FIG. 4, the return lines 17, 27, 37 to the main return hose line 9 are shut off at the valves. Accordingly, the hydraulic fluid in the barrels 11, 21 31, below the piston heads 15, 25, 35, and in the oil pipes 14, 24, 34, and in the lines 17, 27, 37, is trapped at the closed valves V1 through V6.

Pressure is applied to the upper surface of the piston head 25 by pump P through hose line 8 and inlet port 120 of the center cylinder 20. An opening 29 in the outer wall of piston rod 22 near piston head 25, provides communication between the upper portion 23 of barrel 21 and the interior of the hollow rod 26. Thus, the pressure of pump P is also applied to the upper surfaces of the two other piston heads 15 and 35 through rod 26, line 28, lines 18 and 38, and rods 16 and 36. Thus, the pressure of the pump P is applied equally to the upper surfaces of all three piston heads 15, 25, 35, and the pistons take a position determined by the back pressure of the fluid on the underside of the piston heads.

Starting from the positions shown in FIG. 4, if any one (or more) of the valves V1, V3 and V5 is actuated to its open position its associated piston rod will be caused to retract, and if any one (or more) of the valves V2, V4 and V6 is actuated to its open position, its associated piston rod will be caused to extend. Thus, by controlling the conditions of the solenoid-actuated control valves V1 through V6, the pistons rods 16, 26, 36 may be placed in any desired position, thereby placing the bucket 40 in any position, within the scope of the extension of the piston rods.

In the discussion of the operation and condition of the solenoid valves V1-V10, the valve is said to be "closed" when it prevents the flow of fluid therethrough, and the valve is said to be "open" when it allows the flow of fluid therethrough.

In FIG. 4, the solenoid valves V1-V6, and V7-V10, are all shown in their normally closed positions. To understand the operation of the hydraulic system of FIG. 4, consider what happens when, for example, valve V4 is actuated to its open position. When this occurs, hydraulic pressure from pump P is applied, through hose line 8, inlet valve 120, upper portion 23 of cylinder 20, opening 29, annular chamber 26 of piston 22, hose line 28, actuated valve V4 in open position, line 27, and pipe 24, to the portion of the barrel 21 which is below piston head 25, thereby causing the piston head 25 to move upwardly, thereby extending piston 22. Pistons 12 and 32 remain unchanged since valves V2 and V6 remain in closed position.

If, at any time, valve V2 (or valve V6) is actuated to its open position, the respective piston 12, 32 associated therewith will extend due to the pressure from pump P applied, through line 8, inlet port 120, portion 23 of cylinder 20, opening 29, annular chamber 26 of rod 22, line 28, open valve V2 (or V6), line 17 (or 37) and pipe 14 (or 34), thereby causing piston head 15 (or 35) to move upwardly, thereby extending the piston 12 (or 32) or both if both of the valves V2 and V6 are actuated to open position.

To retract one or more of the pistons, one or more of solenoid valves V1, V3, and V5 is actuated to open position. Assume, for example, that V5 is actuated to open position. When this happens, the fluid line 37 from pipe 34 is connected to the return line 9 and fluid flows upwardly through pipe 34, line 37, open valve V5, and return line 9 to the reservoir. This allows piston head 35 to move downwardly under the pressure which is being exerted on the upper surface of head 35 by pump P operating through line 8, inlet port 120, portion 23 of cylinder 20, opening 29, annular chamber 26, line 28, line 38 and annular cavity 36 of cylinder 30.

In a manner similar to that just described, pistons 12 and/or 22 may be retracted by opening valve V1 and/or V3.

Figure 5:
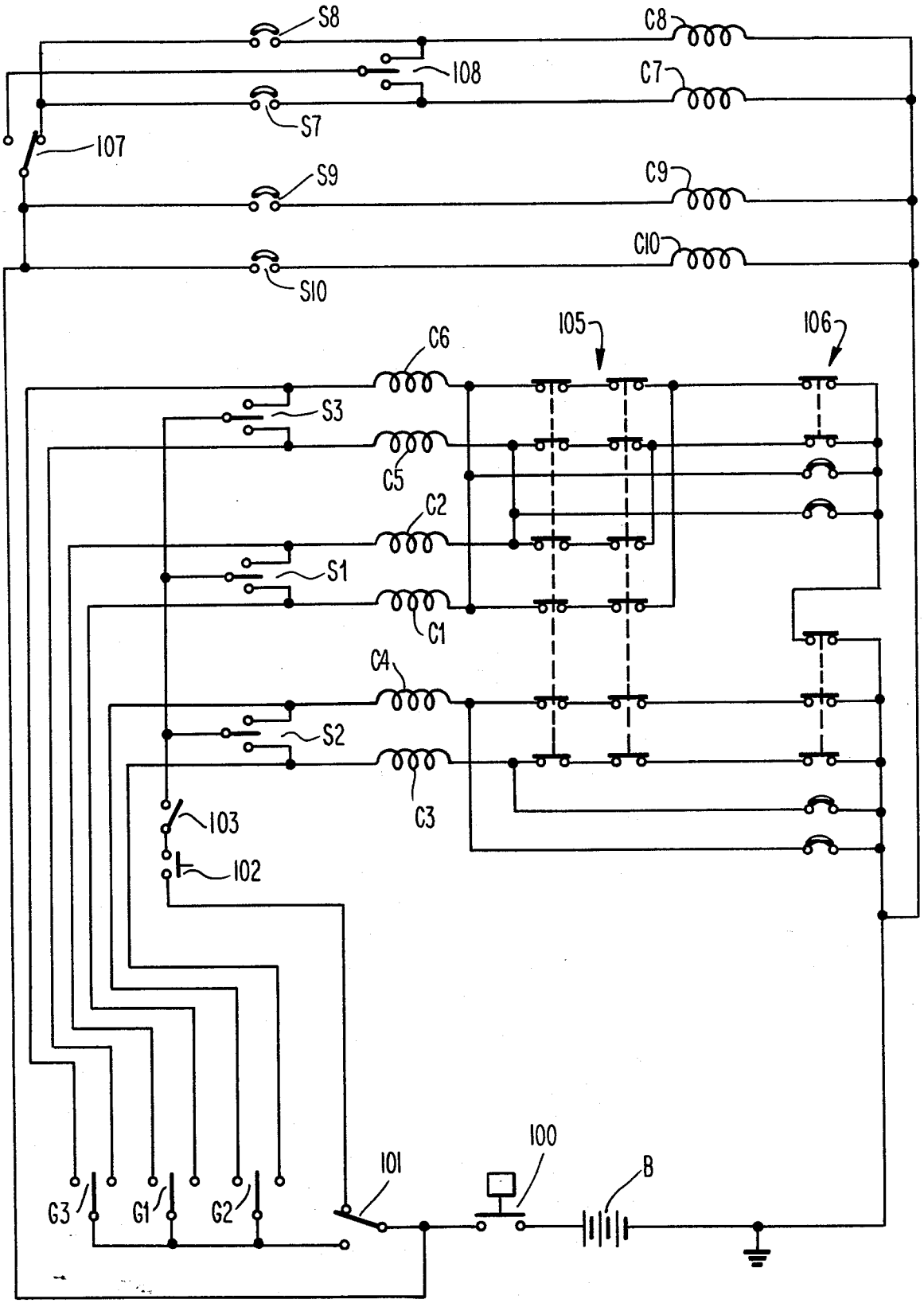
FIG. 5 is a schematic diagram showing electrical circuitry which may be used to control the operation of the solenoid valves of FIG. 4 which are used in the hydraulic system of FIG. 4.

Solenoid valves V7 and V8 control automatically upper leveling cylinder 50. Valves V9 and V10 control automatically lower leveling cyclinder 60. These four valves V7-V10 are controlled by mercury switches which are shown in FIG. 5 and described later.

Figure 2:
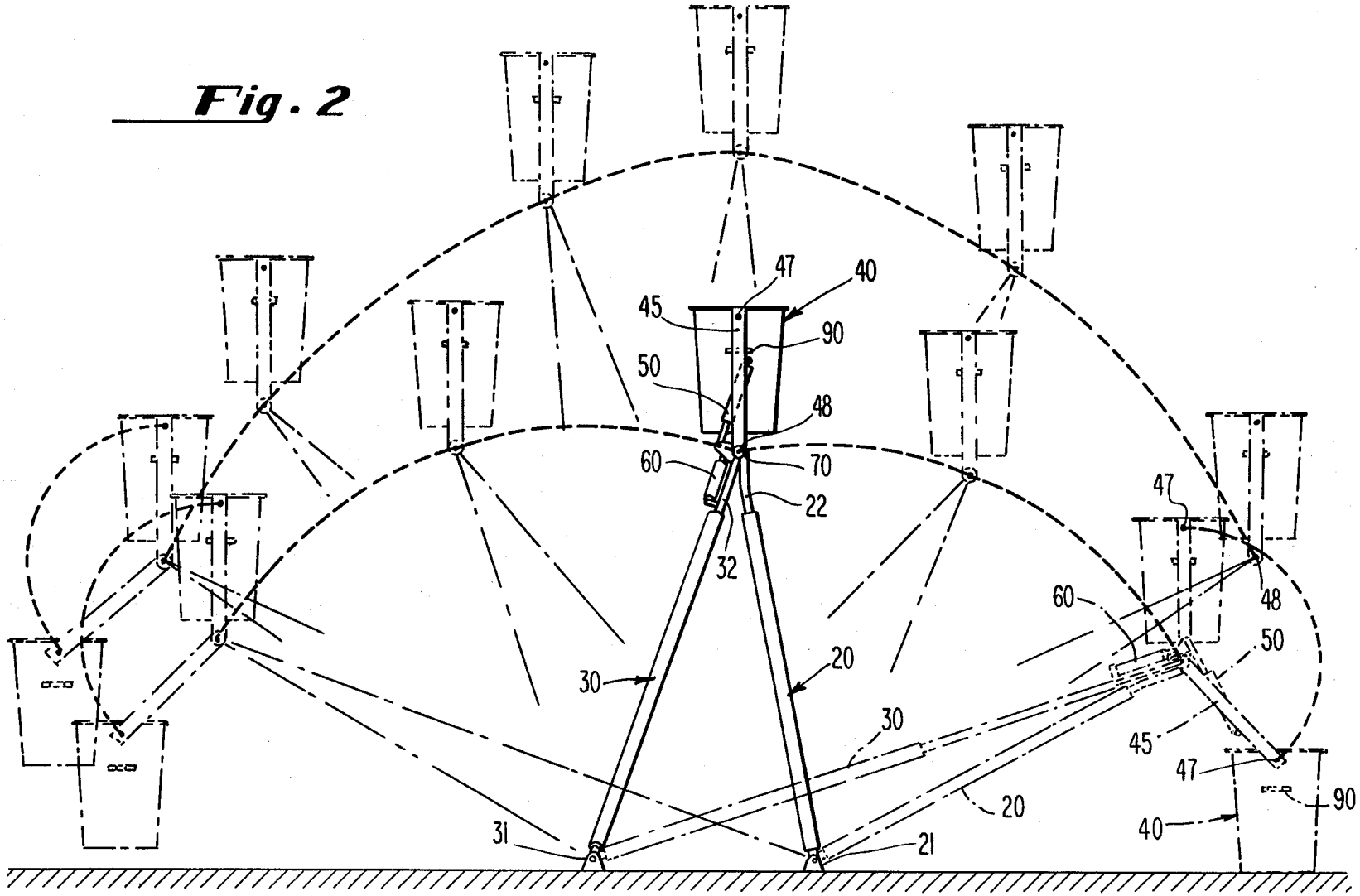
FIG. 2 is an elevational view, looking in the plane of the line 2—2 of FIG. 1, showing, in solid line, the bucket with hydraulic cylinders in fully retracted positions and showing, in phantom, some of the variable positions which may be assumed by the bucket in the plane of line 2—2 (FIG. 1) and in planes which are parallel thereto.

The function of upper leveling cylinder 50 is to maintain jib boom 45 in a vertical position irrespective of the position to which the bucket 40 is moved by the tripod in the plane illustrated in FIG. 2 (or in any plane parallel to the plane of FIG. 2).

Figure 3:
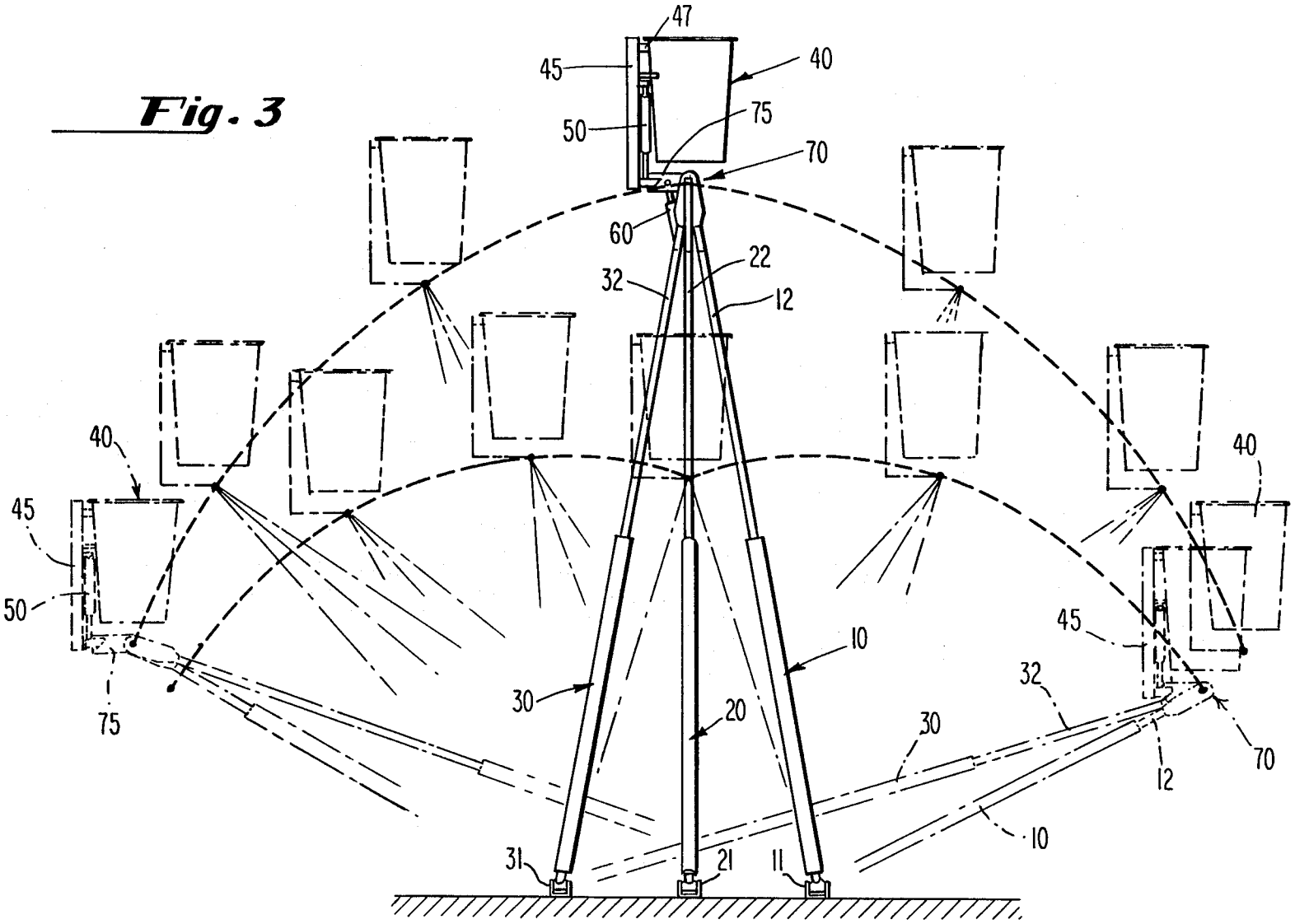
FIG. 3 is an elevational view looking in the plane of the line 3—3 of FIG. 1 (which is at right angles to the plane of FIG. 2) showing, in solid line, the bucket with hydraulic cylinders fully extended and showing, in phantom, some of the variable positions which may be assumed by the bucket in planes which are at right angles to those shown in FIG. 2.

The function of lower leveling cylinder 60 is to maintain the lateral arm 75 in a horizontal position irrespective of the position to which the bucket 40 is moved by the tripod in the plane illustrated in FIG. 3 (or in any plane parallel to the plane of FIG. 3).

Referring now to FIG. 2, since cylinders 10 and 30 are in a common plane, cylinder 10 is hidden from view. If the pistons of cylinders 10 and 30 are extended and the piston of cylinder 20 is not extended, bucket 40 will move from the position shown in solid line in FIG. 2 to the phantom position shown in the right. When this occurs, bucket 40 would depart from its vertical upright position unless means are provided to prevent such departure. Departure of bucket 40 from its upright position is prevented, in accordance with the present invention, by one of the mercury switches S7-S8 (FIG. 5) and by one of the solenoid actuated valves V7-V8. In the present example, when the bucket is swung to the right, as viewed in FIG. 2, mercury switch S7 will close thereby opening solenoid valve V7 and allowing the pressure on the underside of piston head 55 to be relieved causing piston head 55 to fall thereby retracting piston rod 56 until jib boom 45 and bucket 40 are vertically upright at which time the mercury switch S7 will open and solenoid valve V7 will close. The action just described is repeated and continuous so long as the tripod continues to swing the bucket 40 the right.

When the tripod is so manipulated as to swing bucket 40 to the left, the leveling action to maintain jib boom 45 and bucket 40 upright is controlled by mercury switch S8 (FIG. 5) and solenoid valve V8. Valve V8 controls the extension of piston rod 56 by allowing pump pressure to be applied through inlet port 53 to the underside of piston head 55.

In a manner similar to that just described, when bucket 40 is swung in the plane of FIG. 3, the bucket is maintained in upright position by lateral arm 75. This arm is maintained horizontal by lower leveling cylinder 60 controlled by mercury switches S9, S10 (FIG. 5) and solenoid control valves V9 and V10. When the tripod swings the bucket 40 to the right, as viewed in FIG. 3, the bucket is maintained upright by retracting the piston rod 66 of cylinder 60. This is controlled by mercury switch S10 and solenoid valve V10. When the tripod swings bucket 40 to the left in FIG. 3, the bucket is maintained upright by extending piston rod 66. This is controlled by mercury switch S9 and solenoid valve V9.

In FIG. 1, mercury switches S7, S8 are shown mounted in the basket 40, and mercury switches S9, S10 are shown mounted on jib boom 45. These switches could be mounted elsewhere.

FIG. 5 is a schematic of the electrical circuitry which controls the hydraulic system of FIG. 4. Power is supplied from a battery B, typically a 12-volt battery, through a normally-open pressure loss interlock switch 100 which is manually closed. A mode selector switch 101 controls whether the apparatus is to be controlled by three manually operable ground control switches G1, G2, G3, or by three manual control switches S1, S2 and S3 located in the bucket. In FIG. 5, the mode selector switch is shown set to give control to the manually operable control switches S1 S2 and S3. These are preferably toggles switches and are shown in normally open position. Switch 102 is a normally open dead man interlock. Switch 103 is a normally open bucket latch interlock.

Each of the switches S1, S2 and S3 may be moved by the operator in the bucket to one or the other of two closed positions to actuate one or the other of two solenoid coils. The solenoid coils are identified by reference numbers corresponding to those of the control valves V1 through V6 of FIG. 4. For example, solenoid coil C1 controls solenoid valve V1, solenoid coil C2 controls solenoid valve V2, etc. The circuits are completed to ground through sets of limit switches 105 and 106 whose functions are protective and not important to the invention claimed in the present application. It may be stated briefly that the purpose of some of the limit switches is to prevent the cylinders C10, C20 and C30 from being put in extreme angular positions in which the angle between the cylinders is less than say 10°. The smaller angles are encountered when the cylinders are moved to a position to place the bucket close to ground.

Mercury switches S7 through S10 shown in FIG. 5 are normally open. As previously described, these mercury switches control automatically the leveling valves V7 through V10 by controlling automatically the solenoid coils C7 through C10 in response to sensing departure of the bucket from upright position.

To allow the operator to enter and to leave the bucket 40, the bucket is placed in the so-called dismount position shown in phantom in the lower right and lower left in FIG. 2. In order to place the bucket 40 in the dismount positions shown, it is necessary to disable the automatic leveling system for jib boom 45, while maintaining the automatic leveling system for lateral arm 75. This is done by manually throwing selector switch 107 (shown in the upper left of FIG. 5) to the manual position. (The select switch 107 is shown in FIG. 5 in the automatic position). With select switch 107 in the manual position, the jib boom 45 is under the control of the jib boom control switch 108. This switch 108 manually controls leveling cylinder 50 by manually controlling solenoid coils C7, C8 to control the extension and retraction of the piston rod of cylinder 50. The operator also releases the latch 90 by manually pulling the knob 91 to swing the arm 92 pivotally thereby to withdraw the cam latch 93 thereby to allow bucket 40 to swing about pivot pin 47.

The invention has been described with particular reference to a man-carrying aerial bucket. However, the tripod arrangement and controls described may also be used for other aerial loads. The control system has been described as an electro-hydraulic system, which is preferred. But the control system could be entirely hydraulic, with the solenoid valves and mercury switch being replaced by hydraulic valves and ball valves. Or, the tripod aerial lift device could be entirely electrically controlled, with the hydraulic cylinders being replaced with motor driven screw jacks.

What is claimed is:

1. An aerial lift apparatus comprising:

a. a man-carrying aerial bucket;

b. a tripod comprising three hydraulic cylinders each having a barrel and an extendable-retractable piston rod;

c. means for mounting the lower ends of the three cylinders for pivotal movement in two planes;

d. a universal vertex connector pin assembly;

e. means at the upper ends of said piston rods for connecting said piston rods to said vertex connector pin assembly;

f. a lateral arm;

g. means for pivotally connecting one end of said lateral arm to said vertex connector pin assembly;

h. a jib boom;

i. means for pivotally connecting the other end of said lateral arm to the lower end of said jib boom;

j. means for pivotally supporting said bucket to the upper end of said jib boom;

k. means for latching said jib boom to said bucket in the vertical plane of said bucket;

l. a hydraulic system including solenoid control valves for each cylinder;

m. an electrical system including manually operable switches for controlling the solenoid valves for selectively and individually controlling the extension and retraction of the piston rods in said three hydraulic cylinders, thereby to control the movement and positioning of the bucket.

2. Apparatus according to claim 1 wherein:

a. said hydraulic system includes first and second hydraulic leveling cylinders;

b. means pivotally connect one end of said first leveling cylinder to said lateral arm and the other end to one of said piston-rod connector means;

c. means pivotally connect one end of said second leveling cylinder to said jib boom and the other end to said other end of said lateral arm;

d. said electrical system includes first automatic switch means for controlling said first leveling cylinder in response to departure of said lateral arm from horizontal position;

e. said electrical system includes second automatic switch means for controlling said second leveling cylinder in response to departure of said jib boom from vertical position.

3. An aerial lift apparatus comprising:

a. a aerial load;

b. a tripod comprising three hydraulic cylinders each having as components a barrel and an extendable-retractable piston rod;

c. means for mounting the lower end one of said components of each of the three cylinders for pivotal movement in two planes;

d. a universal vertex pin connection;

e. means at the upper end of the other component of each of said three cylinders for connecting said other component to said vertex pin connection;

f. a lateral arm pivotally connected at one end to said vertex pin connection;

g. a vertical boom pivotally connected at its lower end to the other end of said lateral arm;

h. means attaching said vertical boom to said load, i. a hydraulic system including solenoid control valves for each cylinder;

j. an electrical system including manually operable switches for controlling said solenoid valves for selectively and individually controlling the extension and retraction of the piston rods in said three hydraulic cylinders, thereby to control the movement and positioning of said load; and k. means for automatically maintaining said load above and in a desired orientation relative to said vertex pin connection.

4. Apparatus according to claim 3 wherein:

a. said hydraulic system includes first and second hydraulic leveling cylinders and associated solenoid control valves;

b. means pivotally connect one end of said first leveling cylinder to said lateral arm and the other end to one of said cylinder connector means;

c. means pivotally connect one end of said second leveling cylinder to said vertical boom and the other end to said other end of said lateral arm;

d. said electrical system includes first automatic switch means for controlling the associated solenoid control valves of said first leveling cylinder in response to departure of said lateral arm from horizontal position;

e. said electrical system includes second automatic switch means for controlling the associated solenoid control valves of second leveling cylinder in response to departure of said vertical boom from vertical position.

5. Apparatus according to claim 3 wherein:

a. said one component of said cylinders is said barrel and said other component is said piston rod.

6. Apparatus according to claim 4 wherein:

a. said one component of said cylinders is said barrel and said other component is said piston rod.

7. Apparatus according to claim 3 wherein:

a. said load is a bucket;

b. said means for attaching said vertical boom to said load includes a pivotal pin at the upper end of said boom on which said bucket is supported and latch means for latching said boom in vertical position to said bucket in upright position.

8. Apparatus according to claim 4 wherein:

a. said load is a bucket;

b. said means for attaching said vertical boom to said load includes a pivotal pin at the upper end of said boom on which said bucket is supported and latch means for latching said boom in vertical position to said bucket in upright position.

9. Apparatus according to claim 5 wherein:

a. said load is a bucket;

b. said means for attaching said vertical boom to said load includes a pivotal pin at the upper end of said boom on which said bucket is supported and latch means for latching said boom in vertical position to said bucket in upright position.

10. Apparatus according to claim 6 wherein:

a. said load is a bucket;

b. said means for attaching said vertical boom to said load includes a pivotal pin at the upper end of said boom on which said bucket is supported and latch means for latching said boom in vertical position to said bucket in upright position.

11. Apparatus according to claim 4 wherein:

a. said first and second automatic switch means comprise mercury switches.

12. Apparatus according to claim 8 wherein:

a. said first and second automatic switch means comprise mercury switches.

13. Apparatus according to claim 3 wherein said universal vertex pin connection includes:

a. a hub barrel having an axial recess and a transverse pin hole through said recess for receiving a pivot pin.

14. Apparatus according to claim 13 wherein said means for connecting said cylinder component to said vertex pin connection includes;

a. a fitting on the center cylinder component adapted to be inserted into said barrel recess;

b. said fitting having a transverse hole adapted to receive said pivot pin.

15. Apparatus according to claim 14 wherein said means for connecting said cylinder component to said vertex pin connection includes:

a. fittings on the other two cylinder components having holes therein for receiving said hub barrel on which said fittings are pivotal.

16. An aerial lift apparatus comprising:

a. an aerial load;

b. a tripod comprising three extendible-retractable units each having as components a body portion and an extendible-retractable leg;

c. means for mounting the lower ends of one of the components of each extendible-retractable unit for pivotal movement in two planes;

d. a universal vertex connector pin assembly;

e. means at the upper ends of the other of said components of each extendible-retractable unit for connecting said other component to said vertex connector pin assembly;

f. a lateral arm;

g. means for pivotally connecting one end of said lateral arm to said vertex connector pin assembly;

h. a boom;

i. means for pivotally connecting the other end of said lateral arm to the lower end of said boom;

j. means for attaching said boom to said load; and k. a control system for each extendible-retractable unit for controlling selectively and individually the extension and retraction of said three legs, thereby to control the movement and positioning of the load.

* * * * *